US008974264B2

(12) United States Patent
McCafferty et al.

(10) Patent No.: US 8,974,264 B2
(45) Date of Patent: Mar. 10, 2015

(54) FIGURINE LAUNCHER

(75) Inventors: Jim McCafferty, San Clemente, CA (US); Greg Leong, Irvine, CA (US); Dominic Laurienzo, Los Angeles, CA (US); Rip Lopusnak, Canoga Park, CA (US)

(73) Assignee: JAKKS Pacific, Inc., Malibu, CA (US)

( * ) Notice: Subject to any disclaimer, the term of this patent is extended or adjusted under 35 U.S.C. 154(b) by 400 days.

(21) Appl. No.: 13/443,822

(22) Filed: Apr. 10, 2012

(65) Prior Publication Data

US 2013/0263836 A1 Oct. 10, 2013

(51) Int. Cl.

| | |
|---|---|
| ***A63H 13/16*** | (2006.01) |
| ***A63H 17/00*** | (2006.01) |
| ***A63H 27/14*** | (2006.01) |
| ***A63H 33/00*** | (2006.01) |

(52) U.S. Cl.

CPC ..... *A63H 17/008* (2013.01); *A63H 13/16* (2013.01)

USPC ..... 446/429; 446/308; 446/310; 446/430; 446/435; 446/487; 124/10; 124/16; 124/79; 273/129 R; 463/64

(58) Field of Classification Search

CPC ... A63H 17/008; A63H 13/16; A63H 33/003; A63H 27/14

USPC ..... 446/308, 310, 429, 430, 435, 487; 124/10, 16, 79; 273/129 R; 463/64

See application file for complete search history.

(56) References Cited

U.S. PATENT DOCUMENTS

| | | | | | |
|---|---|---|---|---|---|
| 1,256,575 | A | * | 2/1918 | Koprinski | 124/10 |
| 2,731,765 | A | * | 1/1956 | Carver | 446/409 |
| 3,782,032 | A | * | 1/1974 | Glass et al. | 446/429 |
| 3,797,164 | A | * | 3/1974 | Glass et al. | 446/397 |
| 3,952,442 | A | * | 4/1976 | Livesey et al. | 446/429 |
| 4,087,935 | A | * | 5/1978 | Edmisson et al. | 446/423 |
| 4,192,093 | A | * | 3/1980 | Hamano | 446/427 |
| 4,423,871 | A | * | 1/1984 | Mucaro | 463/64 |
| 4,464,860 | A | * | 8/1984 | Onodera | 446/491 |
| 4,472,906 | A | * | 9/1984 | Cook et al. | 446/429 |
| 4,575,348 | A | * | 3/1986 | Wiggs et al. | 446/310 |
| 4,654,018 | A | * | 3/1987 | Farrington et al. | 446/38 |
| 4,690,654 | A | * | 9/1987 | DeLaney | 446/28 |
| 4,736,943 | A | * | 4/1988 | Fukuda et al. | 472/54 |
| 4,737,135 | A | * | 4/1988 | Johnson et al. | 446/430 |
| 4,817,936 | A | * | 4/1989 | Matsuda | 446/310 |
| 4,946,413 | A | * | 8/1990 | Lehmann et al. | 446/28 |
| 5,173,071 | A | * | 12/1992 | Hoeting | 446/429 |
| 5,525,086 | A | * | 6/1996 | Gentile et al. | 446/41 |

(Continued)

*Primary Examiner* — Gene Kim

*Assistant Examiner* — Alexander Niconovich

(74) *Attorney, Agent, or Firm* — Tope-McKay & Associates

(57) ABSTRACT

A figurine launcher is described. The figurine launcher includes at least two shell components. The shell components are hingedly attached with one another to move between an open position and a closed position. An open mechanism is attached with at least one of the shell components and is adapted to allow a user to selectively separate the shell components when in the closed position. A launch positioning mechanism is attached with at least one of the shell components. The launch positioning mechanism is adapted to engage with a figurine and conceal the figurine within the housing when the shell components are in a closed position. Alternatively, when the shell components are in an open position, the launch positioning mechanism is adapted to move the figurine into a launch position. When in the launch position, the user can compress the shell components to force the figurine from the launcher.

8 Claims, 3 Drawing Sheets

(56) References Cited

U.S. PATENT DOCUMENTS

| | | | | |
|---|---|---|---|---|
| 6,343,969 | B1 * | 2/2002 | Spector | 446/309 |
| 6,860,787 | B1 * | 3/2005 | Woodhouse | 446/268 |
| 7,306,504 | B2 * | 12/2007 | Saucier | 446/487 |
| 7,874,892 | B2 * | 1/2011 | Hippely | 446/429 |
| 7,950,977 | B2 * | 5/2011 | Sun et al. | 446/435 |
| 8,011,994 | B2 * | 9/2011 | Fink et al. | 446/429 |
| 8,376,806 | B2 * | 2/2013 | Sun et al. | 446/431 |
| 2009/0075556 | A1 * | 3/2009 | Sun et al. | 446/429 |
| 2014/0099859 | A1 * | 4/2014 | Weil | 446/435 |

* cited by examiner

FIGURINE LAUNCHER

BACKGROUND OF THE INVENTION (1) Field of Invention

The present invention relates to a toy launcher and, more particularly, to a toy launcher for launching an item concealed therein.

(2) Description of Related Art

Toy launchers have long been known in the art. Toy launchers are typically used to launcher a variety of projectiles. By way of example, toy launchers are often provided in the form of toy guns that shoot soft pellets or disks. Alternatively, other launchers have been devised that launch vehicles, such as 1:64 scale die-cast cars.

While launchers of the prior art are operable for launching pellets and vehicles, nothing heretofore devised conceals and launches a figurine.

Thus, a continuing need exists for a figurine launcher that is operable for both concealing and launching a figurine stored therein.

SUMMARY OF INVENTION

The present invention relates to figurine launcher. The figurine launcher includes at least two semi-spherically shaped shell components that collectively form a spherically-shaped housing. The shell components are hingedly attached with one another to move between an open position and a closed position. An open mechanism is attached with at least one of the shell components and is adapted to allow a user to selectively separate the shell components when in the closed position. A launch positioning mechanism is attached with at least one of the shell components. The launch positioning mechanism is adapted to engage with a figurine and conceal the figurine within the housing when the shell components are in a closed position. Alternatively, when the shell components are in an open position, the launch positioning mechanism is adapted to move the figurine into a launch position. When in the launch position, the user can compress the shell components to force the figurine from the launcher.

In another aspect, the launch positioning mechanism includes a spring-loaded launch platform that is hingedly connected with a launch platform arm. The launch platform arm is spring-loaded and hingedly connected with the bottom shell component to lift the launch platform from the bottom shell component.

In yet another aspect, a launch platform lock is attached with the bottom shell component for locking the launch platform.

Additionally, a catch release is attached with the top shell component. The catch release is adapted to release the launch platform lock from the launch platform.

In yet another aspect, a figurine is included. The figurine has a base with a back edge. The back edge slants downwardly such that when the figurine is positioned within the launch position, compression of the shell components towards one another forces the figurine from the launcher.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figures 1A, 1B, 1C:
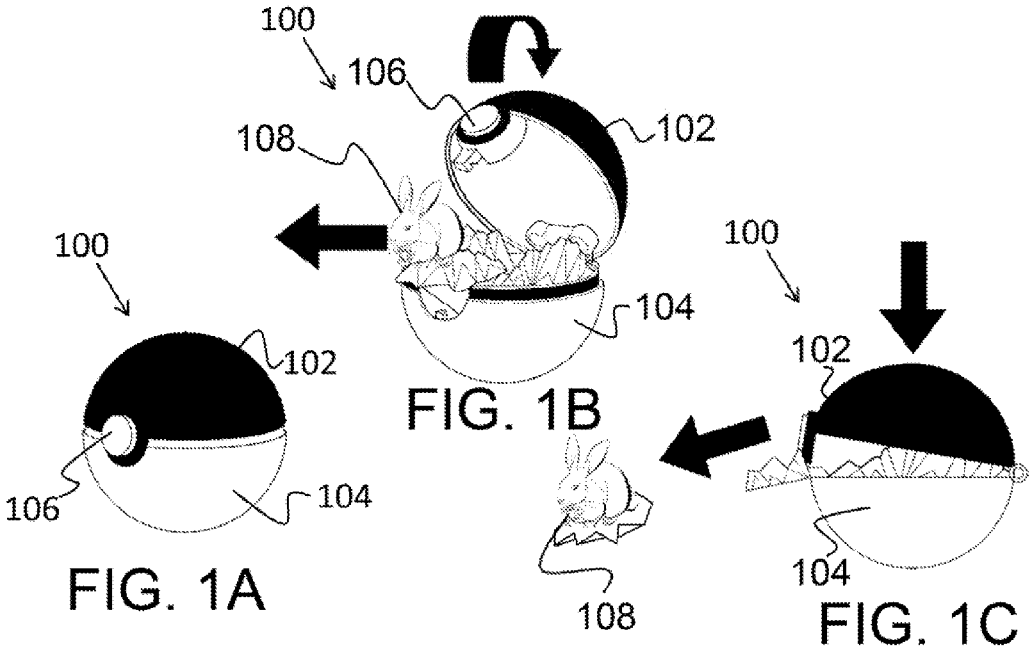
FIG. 1A is an illustration depicting a figurine launcher in a closed position.
FIG. 1B is an illustration depicting the figurine launcher in an open position to expose and position the figurine for launching.
FIG. 1C is an illustration depicting the figurine launcher as launching the figurine.

The present invention relates to a toy launcher and, more particularly, to a toy launcher for launching an item concealed therein. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

As shown in FIG. 1, the present invention relates to a launcher 100 for launching an item concealed therein. It should be understood that although the present invention is described as a figurine launcher, the invention is not intended to be limited thereto as it can be utilized to launch any suitably concealable item, non-limiting examples of which include figurines, vehicles, ships, etc.

The launcher 100 includes at least two shell components (a top shell component 102 and a bottom shell component 104) that collectively form a housing. The shell components 102 and 104 are connected with one another to allow for selective opening of the launcher 100. As a non-limiting example, the shell components 102 and 104 are hingedly attached with one another. Further, the shell components 102 and 104 are formed in any suitable shape such that collectively, they form the housing, a non-limiting example of which includes being semi-spherically shaped such that the housing is spherically shaped.

Additionally, the launcher 100 includes an open mechanism 106 to allow a user to selectively open the launcher 100. The open mechanism 106 is any suitable mechanism or device that allows for selective locking and opening of the launcher 100, a non-limiting example of which includes a button and latch.

As shown in FIG. 1B, once the open mechanism 106 is actuated, the launcher 100 opens with the two shell components 102 and 104 separating. In doing so, the figurine 108 is lifted up and into a launch position.

As shown in FIG. 1C, once in the launch position, the two shell components 102 and 104 can be compressed together to squeeze the figurine 108 and thereby, force the figurine from the launcher 100.

Figure 2A:
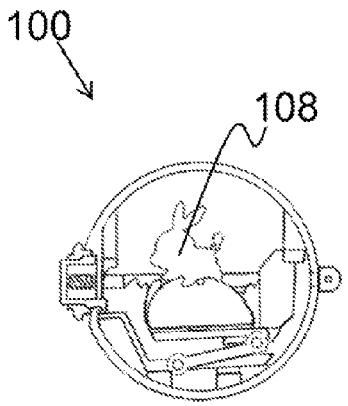
FIG. 2A is a cross-sectional, side-view illustration of the figurine launcher, depicting the figurine launcher in a closed position.
Figure 2B:
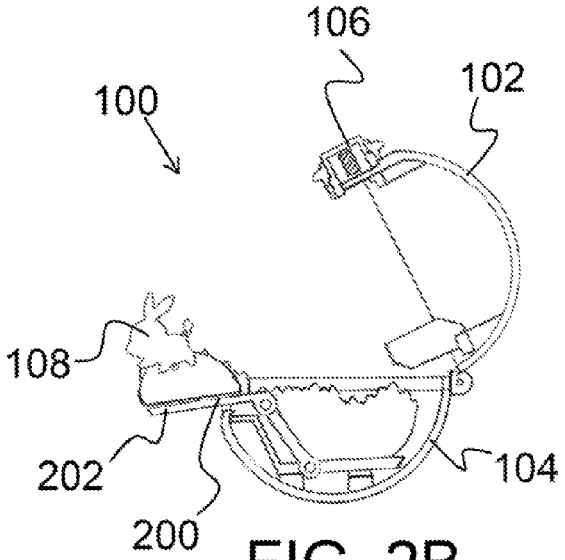
FIG. 2B is a cross-sectional, side-view illustration of the figurine launcher, depicting the figurine launcher as being opened to position the figurine for launching.

For further understanding, FIGS. 2A through 2D provide cross-sectional, side-view illustrations of the launcher 100 in operation. More specifically, FIG. 2A illustrates the launcher 100 in a closed position, with the figurine 108 concealed therein. As shown in FIG. 2B, actuation of the open mechanism 106 causes the two shell components 102 and 104 to separate, allowing a launch positioning mechanism 200 to position the figurine 108 in an appropriate position for launching. For example, the launch positioning mechanism 200, when activated, lifts a launch platform 202 up and out of the shell component 104 to position the figurine 108 at a launch position. The launch positioning mechanism 200 is described in further detail below.

Figure 2C:
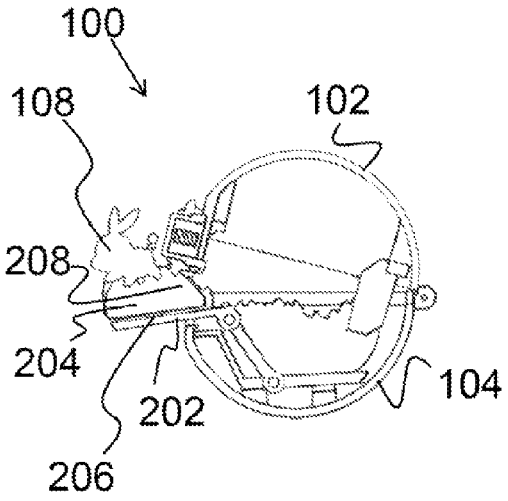
FIG. 2C is a cross-sectional, side-view illustration of the figurine launcher, depicting the figurine launcher as closing down upon a figurine to launch the figurine.

As shown in FIG. 2C, once in the launch position, a user can compress the shell components 102 and 104 towards one another (e.g., by pushing down on the top shell component 102). In compressing the shell components 102 and 104 towards one another, the lid (i.e., shell component 102) is squeezed against a base 204 of the figurine 108 and effectively pinches the base 204 against the launch platform 202. In this case, the figurine 108 includes a base 204 with a back edge 208 and a roll component 206. The back edge 208 of the base 204 is formed to slant downwardly. Thus, in pinching the back edge 208 of the base 204 between the shell component 102 and the platform 202, the figurine 108 and its corresponding base 204 are squeezed/forced from the launcher 100. The roll component 206 is any suitable mechanism or device that assists the figurine LOS in rolling smoothly and effectively across a surface, non-limiting examples of which include wheels and a roller ball.

Figure 2D:
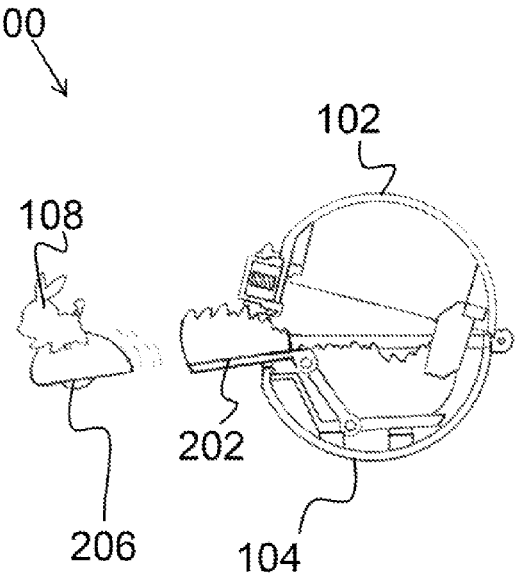
FIG. 2D is a cross-sectional, side-view illustration of the figurine launcher, depicting the figurine as being launched from the figurine launcher.

As shown in FIG. 2D, after the shell components 102 and 104 are compressed towards one another (i.e., the top shell component 102 is forced towards the launch platform 202), the figurine 108 is launched from the launcher 100 and allowed to effectively roll away with assistance from the roll component 206.

Figure 3:
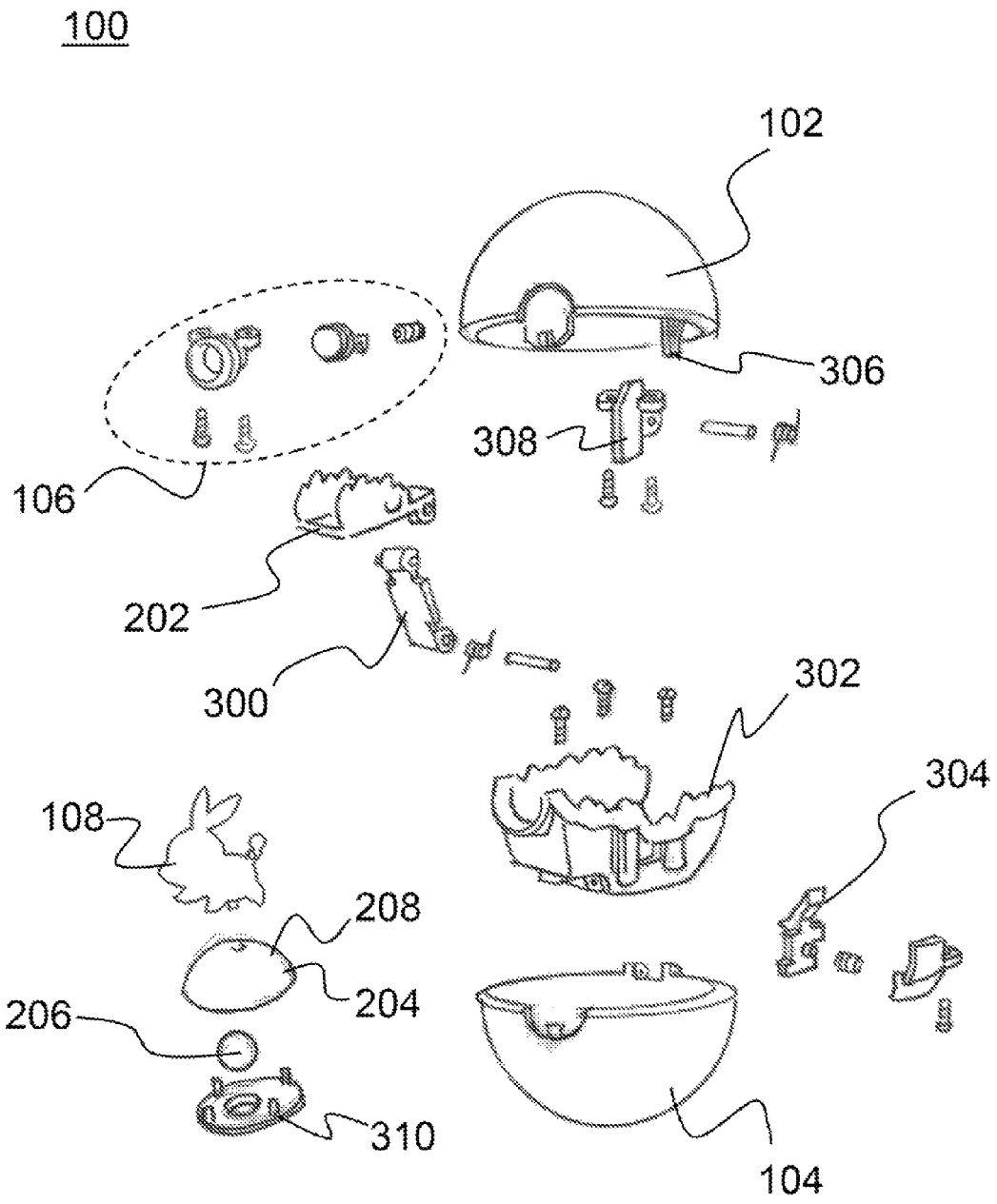
FIG. 3 is an exploded-view illustration, depicting various components of the figurine launcher.

As can be appreciated, there are variations by which the launcher 100 can be formed to allow a figurine 108 to be concealed therein and, upon opening of the launcher 100, lifted out and positioned for launching. For example and as shown in FIG. 3, the launcher 100 can be formed to include a variety of components. As shown, the shell components 102 and 104 form the housing of the launcher 100. Concealed therein is the launch positioning mechanism (depicted as element 200 in FIG. 2B). Referring to FIG. 3, the launch positioning mechanism is any suitable mechanism or device that is operable for engaging with the figurine 108 and holding the figurine 108 while the launcher 100 is in the closed position and, when opened, lifting the figurine 108 from the shell component 104 and into a launching position. As a non-limiting example, the launching platform 200 is a spring-loaded launch platform 202 that is pivotally connected with a launch platform arm 300. The launch platform arm 300 is pivotally connected with the shell component 104, either directly or indirectly. In this example, the launch platform arm 300 is spring loaded and pivotally connected with a launch base 302 that is housed within the shell component 104. Thus, through the launch platform arm 300, the launch platform 202 can pivot into the launch base 302 and, alternatively, up and away from the launch base 302 to position the figurine 108 in the launch position. A launch platform lock 304 can also be included to lock the launch platform 202 with the launch base 302 or otherwise within the housing. For example, the launch platform lock 304 is attached with the launch base 302 and is operable for clipping onto and engaging with the launch platform 202 when it is pressed into the launch base 302.

A catch release 306 can also be included. The catch release 306 is any suitable mechanism or device that is operable for releasing the launch platform lock 304 from the launch platform 202. For example, the catch release 306 is a protrusion or tab that is affixed with the top shell component 102. In this aspect, when the top shell component 104 is lowered onto the bottom shell component 104, the catch release 306 engages with the launch platform lock 304 to release it from the launch platform 202. However, because the shell components 102 and 104 are in the closed position, a hold tab 308 can be used to hold the launch platform 202 in place with respect to the launch base 302. When the open mechanism 106 is activated and the shell components 102 and 104 separate, the launch platform 202 is operable for swinging up and out of the bottom shell component 104 to position the figurine 108 in the launch position.

With respect to the figurine 108, it should be understood that the figurine 108 can be formed such that the base 204 with its slanted back edge 208 are an integrally formed component of the figurine 108. For example, although FIG. 3 illustrates the figurine 108 and base 204 as separately formed and attached components, the present invention is not intended to be limited thereto as the components can be integrally formed as a single piece. Further, the roller component 206 (and its corresponding roller casing 310 while desirable, is not a required component of the figurine 108.

What is claimed is:

1. A figurine launcher, comprising:

at least two shell components, the shell components collectively forming a housing, the shell components hingedly attached with one another to move between an open position and a closed position;

an open mechanism attached with at least one of the shell components and adapted to allow a user to selectively separate the shell components when in the closed position; and a launch positioning mechanism attached with at least one of the shell components, the launch positioning mechanism adapted to engage with a figurine and conceal the figurine within the housing when the shell components are in a closed position and, when the shell components are in an open position, the launch positioning mechanism is adapted to move the figurine into a launch position; and a figurine having a base with a back edge, the back edge slanting downwardly such that when the figurine is positioned within the launch position, compression of the shell components towards one another forces the figurine from the launcher.

2. The figurine launcher of claim 1, wherein the shell components include a top shell component and a bottom shell component, such that the launch positioning mechanism is attached with the bottom shell component and wherein when in an open position, the launch positioning mechanism moves the figurine from the bottom shell component and into the launch position.

3. The figurine launcher of claim 2, wherein the launch positioning mechanism includes a spring-loaded launch platform that is hingedly connected with a launch platform arm, the launch platform arm being spring-loaded and hingedly connected with the bottom shell component.

4. The figurine launcher of claim 3, further comprising a launch platform lock attached with the bottom shell component for locking the launch platform.

5. The figurine launcher of claim 4, further comprising a catch release attached with the to shell component, the catch release adapted to release the launch platform lock from the launch platform.

6. The figurine launcher of claim 5, wherein each of the shell components is formed semi-spherically such that when positioned in the closed position, the housing is spherically shaped.

7. The figurine launcher of claim 1, wherein the launch positioning mechanism includes a spring-loaded launch platform that is hingedly connected with a launch platform arm, the launch platform arm being spring-loaded and hingedly connected with at least one shell component.

8. The figurine launcher of claim 1, wherein each of the shell components is formed semi-spherically such that when positioned in the closed position, the housing is spherically shaped.

* * * * *